US008608215B2

(12) United States Patent
Passmann et al.

(10) Patent No.: US 8,608,215 B2
(45) Date of Patent: Dec. 17, 2013

(54) LOAD-RECEIVING MEANS, IN PARTICULAR A HOOK BLOCK OF A LIFTING GEAR

(75) Inventors: Christoph Passmann, Dortmund (DE); Eberhard Becker, Hagen (DE); Daniel Sogemeier, Bochum (DE); Ding Yuan Zhao, Shanghai (CN)

(73) Assignee: Demag Cranes & Components GmbH, Wetter (DE)

( * ) Notice: Subject to any disclaimer, the term of this patent is extended or adjusted under 35 U.S.C. 154(b) by 151 days.

(21) Appl. No.: 13/262,769

(22) PCT Filed: Mar. 30, 2010

(86) PCT No.: PCT/EP2010/054205

§ 371 (c)(1),
(2), (4) Date: Oct. 3, 2011

(87) PCT Pub. No.: WO2010/115779

PCT Pub. Date: Oct. 14, 2010

(65) Prior Publication Data

US 2013/0069379 A1 Mar. 21, 2013

(30) Foreign Application Priority Data

Apr. 11, 2009 (DE) ..... 10 2009 017 718

(51) Int. Cl.
*B66C 1/34* (2006.01)

(52) U.S. Cl.
USPC ..... 294/82.1; 59/95

(58) Field of Classification Search
USPC ..... 294/82.1, 82.11, 82.15; 403/78, 164, 403/165; 59/93, 95; 24/265 H, 598.4, 600.7
See application file for complete search history.

(56) References Cited

U.S. PATENT DOCUMENTS 921,286 A 5/1909 Saunders
931,270 A 8/1909 Clarkson (Continued)

FOREIGN PATENT DOCUMENTS

DE 3220253 A1 12/1982
DE 29817206 U1 3/2000

(Continued)

OTHER PUBLICATIONS

International Search Report and Written Opinion of the International Searching Authority from corresponding Patent Cooperation Treaty (PCT) Application No. PCT/EP2010/054205, mailed Jun. 23, 2010.

(Continued)

*Primary Examiner* — Stephen Vu
(74) *Attorney, Agent, or Firm* — Gardner, Linn, Burkhart & Flory, LLP

(57) ABSTRACT

A load-receiving apparatus is provided in the form of a hook block of a lifting gear, and includes a hook having a shaft and a circumferential groove in which an annular retaining element engages. The annular retaining element is supported on a supporting surface of a suspension element of the load-receiving apparatus. The annular retaining element has the form of a sleeve, which expands starting from the shaft and continuing in the direction of the supporting surface. In order to create a secure load-receiving apparatus, the annular retaining element is designed in the form of a conical sleeve or a truncated cone, and has an exterior outer surface, an interior outer surface due to the sleeve's conical shape, an upper annular top surface, and a lower annular base surface.

18 Claims, 4 Drawing Sheets

(56) References Cited

U.S. PATENT DOCUMENTS

| | | | | |
|---|---|---|---|---|
| 1,150,892 | A * | 8/1915 | Sherwood | 59/95 |
| 1,525,090 | A | 2/1925 | Rutan | |
| 2,553,133 | A | 5/1951 | Conner | |
| 2,625,005 | A | 1/1953 | Myers | |
| 3,092,412 | A | 6/1963 | Drake | |
| 4,017,111 | A | 4/1977 | Sandnes | |
| 4,568,118 | A | 2/1986 | Isao | |
| 4,669,907 | A * | 6/1987 | Patton | 403/78 |
| 4,708,382 | A | 11/1987 | LaCount | |
| 6,193,432 | B1 | 2/2001 | Kampfert | |
| 6,694,574 | B1 | 2/2004 | Sheng | |
| 7,219,937 | B2 * | 5/2007 | Stober et al. | 294/82.1 |
| 7,607,707 | B2 | 10/2009 | Eising et al. | |
| 2007/0261210 | A1 * | 11/2007 | Chen | 24/265 H |

FOREIGN PATENT DOCUMENTS

| | | | |
|---|---|---|---|
| DE | 102005023990 | A1 | 2/2006 |
| DE | 2004034590 | B3 | 4/2006 |
| EP | 1386877 | A2 | 2/2004 |
| EP | 1454870 | A2 | 9/2004 |
| EP | 1616836 | A2 | 1/2006 |
| EP | 2039948 | A1 | 4/2006 |
| JP | 60-26487 | | 2/1985 |
| SU | 131059 | | 2/1960 |
| SU | 1139692 | | 2/1985 |

OTHER PUBLICATIONS

English translation of the International Preliminary Report on Patentability from corresponding Patent Cooperation Treaty (PCT) Application No. PCT/EP2010/054205, mailed Oct. 18, 2011.

* cited by examiner

LOAD-RECEIVING MEANS, IN PARTICULAR A HOOK BLOCK OF A LIFTING GEAR

CROSS REFERENCE TO RELATED APPLICATION

The present application claims the priority benefits of International Patent Application No. PCT/EP2010/054205, filed on Mar. 30, 2010, which is hereby incorporated herein by reference in its entirety.

FIELD OF THE INVENTION

The invention relates to a load-receiving means, in particular a hook block of a lifting gear.

BACKGROUND OF THE INVENTION

A load hook for lifting gear is disclosed in U.S. Pat. No. 2,625,005, which includes a housing and a hook. The housing is formed as a cylindrical sleeve, the lower end of which is partially closed via an annular disc with a central opening. The opposite end of the sleeve is open. The housing is suspended in a conventional manner on a cable or a chain of the lifting gear. The hook has a curved hook part with a hook opening to receive a load lifting means, such as, e.g., a cable, a loop or a belt, and a shaft adjoining the hook part. The shaft is provided in the region of its upper end with a peripheral semi-circular groove and in the assembled condition is inserted into the central opening of the housing. In order to hold the shaft in the housing, a bearing ring is inserted into the housing from above and is supported on the annular disc, this bearing ring being provided with a central opening to receive the shaft and being provided on its upper inner edge with a quadrant-shaped contact surface. For assembly purposes the shaft can be inserted so far into the opening in the annular disc that the groove thereof lies over the support surface of the bearing ring. Then a ring divided into two 180-degree segments and having a fully circular cross-section is inserted into the groove from the sides and the shaft is moved downwards back through the opening so that the annular segments come to rest on the contact surface of the bearing ring. The dimensions of the groove in the ring and of the contact surface are selected in such a way that a snug fit is produced. In order to be able to rotate the hook with respect to the housing about the longitudinal axis of its shaft, roller bearing balls are disposed between the bearing ring and the annular disc, these balls rolling on the annular disc and in a running surface provided at the bottom in the bearing ring.

Furthermore, from the German laid-open document DE 102 36 408 A1 a suspension arrangement for a hook, in particular for hook blocks of lifting gear, is known. The hook again has a shaft which is suspended on a cross-piece which can pivot about a substantially horizontal axis. For this purpose the cross-piece is provided with a through bore transverse to its longitudinal direction, through which bore the free end of the shaft is inserted. In the region of the end of the shaft a peripheral, half-ring shaped groove is also provided which serves to receive a circlip. By means of the circlip the hook is supported on a bearing ring which is supported on the cross-piece via an axial ball bearing. The circlip has a fully-circular cross-section and is split at one point so that it can be mounted. Circlips of this type are conventionally used for securing the axial position of roller bearings. A quadrant-shaped contact surface for receiving the circlip is also provided in this case on the inner upper edge of the bearing ring.

Furthermore, from the German patent DE 32 20 253 C2 a further rotatable load hook for a hook block of a lifting gear is known. Also, in this case, the load hook has a hook shaft, the free end of which is guided through a through bore of a cross-piece of the hook block. In order to be able to support the hook shaft in a rotatable manner on the cross-piece an axial bearing is disposed on the cross-piece coaxial to the through bore. A retaining part in the form of a cylindrical pipe lies on the axial bearing, the retaining part being split in the middle for assembly purposes, being supported in an annular groove in the hook shaft and being held together in the installed position by a connecting sleeve. The connecting sleeve is secured in the longitudinal direction of the hook shaft via a spring ring which is mounted in a peripheral groove in the hook shaft. The load received by the hook is, therefore, carried into the cross-piece via the retaining part. For this purpose, the retaining part is supported in the annular groove of the hook shaft. The retaining part and the annular groove are formed in a specific manner in order to create a secure load hook with an increased service life. The annular groove is produced by a rolling process and, therefore, has a plastically deformed and strengthened surface. Furthermore, the annular groove has a cross-section which has edge regions with a small radius of curvature and a base region with a large radius of curvature. The base region with the large radius of curvature is almost flat. The retaining part in engagement with the annular groove is almost in the form of a cylindrical pipe and is slightly convex to correspond to the shape of the annular groove. The lower end thereof is adjoined by a flange region extending outwards approximately at a right angle, the retaining part lying on the axial bearing via this flange region. The supporting forces are diverted into the flange region in a manner corresponding to the shape of the retaining part for introduction into the axial bearing.

SUMMARY OF THE INVENTION

The present invention provides a secure load-receiving means in the form of a hook block of a lifting gear. The hook block includes a shaft and a peripheral groove into which an annular retaining element engages, which is supported on a bearing surface of a suspension element of the load-receiving means, wherein the annular retaining element is in the form of a sleeve which widens starting from the shaft in the direction of the bearing surface.

According to one aspect of the invention, a load-receiving means in the form of a hook block of a lifting gear, a hook has a shaft and a peripheral groove into which an annular retaining element engages. The annular retaining element is supported on a bearing surface of a suspension element of the load-receiving means. The annular retaining element is in the form of a sleeve which widens starting from the shaft in the direction of the bearing surface. A secure design may be achieved when the annular retaining element is in the form of a conical sleeve in the manner of a truncated cone and has an outer boundary surface, an inner boundary surface owing to the sleeve shape, an upper annular end surface and a lower annular base surface. The conical shape permits particularly satisfactory introduction of the forces resulting from the load-receiving means and the load suspended thereon into the bearing ring. By means of this design, the contact surfaces between the retaining element, the shaft and the groove are enlarged so that the corresponding surface pressing forces can also be controlled more effectively. The articulated mounting of the elongate conical retaining element at the bottom on the bearing ring and at the top at the groove leads to a more uniform distribution of the pressing and tension forces. In this way the retaining element also becomes less susceptible to manufacturing tolerances. The force flux in the retaining element thus passes uniformly between the groove and the bearing surface. In an advantageous manner no shearing stresses arise in the retaining element as compared with a circular retaining element. In addition, an error in assembly in the form of an omission of the annular retaining element can be more readily noticed since the shaft of the hook slides out of the suspension element. This error in assembly can, therefore, also be noticed after the load-receiving means has been fully assembled if the annular retaining element is no longer visible because it is concealed from the outside by other components.

Optionally, provision is made that as seen when the shaft axis of the shaft is oriented vertically, the annular retaining element has a supporting surface at the top, which faces the shaft, and has a standing surface at the bottom, which faces the bearing surface, the supporting surface is in contact with the shaft and the standing surface is in contact with the bearing surface.

High notch stresses may be avoided when the supporting surface and the standing surface are each curved convexly, such as in the form of the arc of a circle. Furthermore, self-centering between the retaining element, shaft and bearing ring may be thereby achieved.

The forces resulting from the load-receiving means and the load suspended thereon are caused to pass through the retaining element in a particularly optimal manner in that the upper annular end surface of the retaining element is formed in the shape of the supporting surface and the lower annular end surface of the retaining element is formed in the shape of the standing surface.

Optionally, provision is made for the inner boundary surface and the outer boundary surface to extend in parallel with each other.

It is constructionally advantageous that a linear contact surface adjoins the curved surface of the peripheral groove and widens in the direction of the bearing surface, and the annular retaining element lies with its inner boundary surface on the contact surface of the peripheral groove. In this way the retaining element is additionally supported at the side by the shaft.

The introduction of the forces resulting from the load-receiving means and the load suspended thereon into the bearing ring is further optimized in that the bearing surface and the standing surface have contours which complement each other when in the contact position, since in this way surface contact between the retaining element and bearing ring is achieved, which protects the components. The same applies for the supporting surface and the curved surface which also have contours which complement each other when in the contact position. Provision may be made for the peripheral groove to have a curved surface which is in contact with the supporting surface of the annular retaining element.

In an alternative embodiment provision is made for the bearing surface to be disposed inside and on top of a bearing ring and the bearing ring is supported via an axial ball bearing on the suspension element. The arrangement of the bearing surface, at this point, favours the introduction of the forces resulting from the load-receiving means and the load suspended thereon into the bearing ring. The use of an axial ball bearing additionally permits the hook to be able to rotate about its shaft axis.

Optionally, the annular retaining element may be divided into at least two segments. In this way, the mounting of the hook onto the suspension element is facilitated since the segments can be inserted more easily into the groove in the shaft from the side and then complement each other, resting in the groove, to form a complete full ring-shaped retaining element.

DESCRIPTION OF THE PREFERRED EMBODIMENTS

Figure 1:
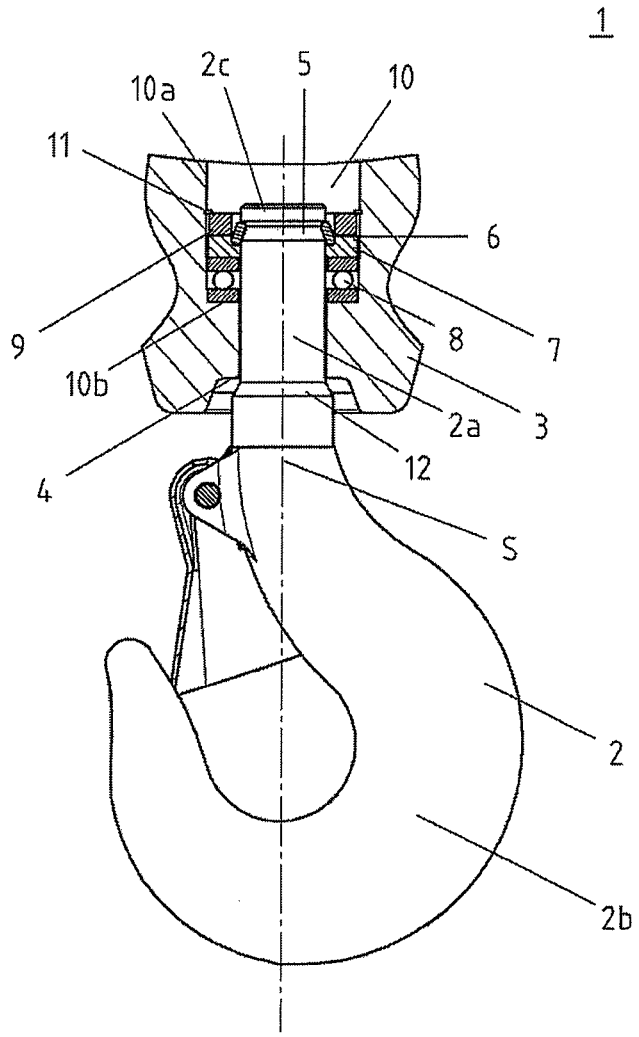
FIG. 1 is a side and partial sectional view of a portion of a load-receiving means in accordance with the present invention.

FIG. 1 shows a view of a partially illustrated load-receiving means 1. A load-receiving means 1 of this type includes a hook 2 and a suspension element which connects the hook 2 to a bearing means, e.g., in the form of a cable, a chain or a belt. In FIG. 1, only a cross-piece 3 is shown to represent the suspension element. By means of the cross-piece 3, the hook 2 is suspended so as to be able to pivot about the longitudinal axis of the cross-piece 3 in a hook block, not shown, having two or more sheaves, of a lifting gear. The cross-piece 3, therefore, essentially has the function of an axle with two opposing cylindrical first and second axle parts, not shown, which are connected to each other via an annular part disposed therebetween with a central through opening 4. The central through opening 4 serves to receive a shaft 2*a* of the hook 2. This shaft 2*a* with its longitudinal extension being essentially vertical when seen with the load-receiving means 1 in the inoperative suspended position is connected at its lower end to a hook-shaped hook part 2*b* of the hook 2. The first axle part and the second axle part are rotatably mounted in the suspension element, not shown, of the load-receiving means 1.

In the event that the load-receiving means 1 is formed as a single strand, i.e., is suspended only on one cable or chain, no cross-piece 3 is used in the conventional manner. The hook 2 is then attached directly to a housing-like suspension element with a corresponding through opening 4. For assembly reasons, this suspension element can be split. The load-receiving means 1 can also be a clevis.

Furthermore, FIG. 1 also shows that the shaft 2*a* of the hook 2 is inserted from below through the through opening 4 and has a peripheral groove 5 on its end 2*c* remote from the hook part 2*b*.

This groove 5 serves to receive an annular retaining element 6 by means of which the hook 2 is supported on a bearing ring 7 with a bearing surface 7*a*. In order not only to be able to pivot the hook 2 about the longitudinal axis of the cross-piece 3, but also to be able to rotate it about a shaft axis S of the shaft 2*a* extending in the longitudinal direction of the shaft 2*a*, the bearing ring 7 is supported on the cross-piece 3 via an axial bearing 8.

FIG. 1 also shows that not only is a through opening 4 disposed in the cross-piece 3, but a cylindrical receiving space 10 adjoins this cylindrical through opening 4 in a concentric manner. The receiving space 10 has a cylindrical inner wall

10*a* which is formed by the cross-piece 3. The diameter of the receiving space 10 is larger than that of the through opening 4 so that the stepped change in diameter produces an annular receiving surface 10*b*. The axial bearing 8 comes to rest on the support surface 10*b*.

Figure 2:
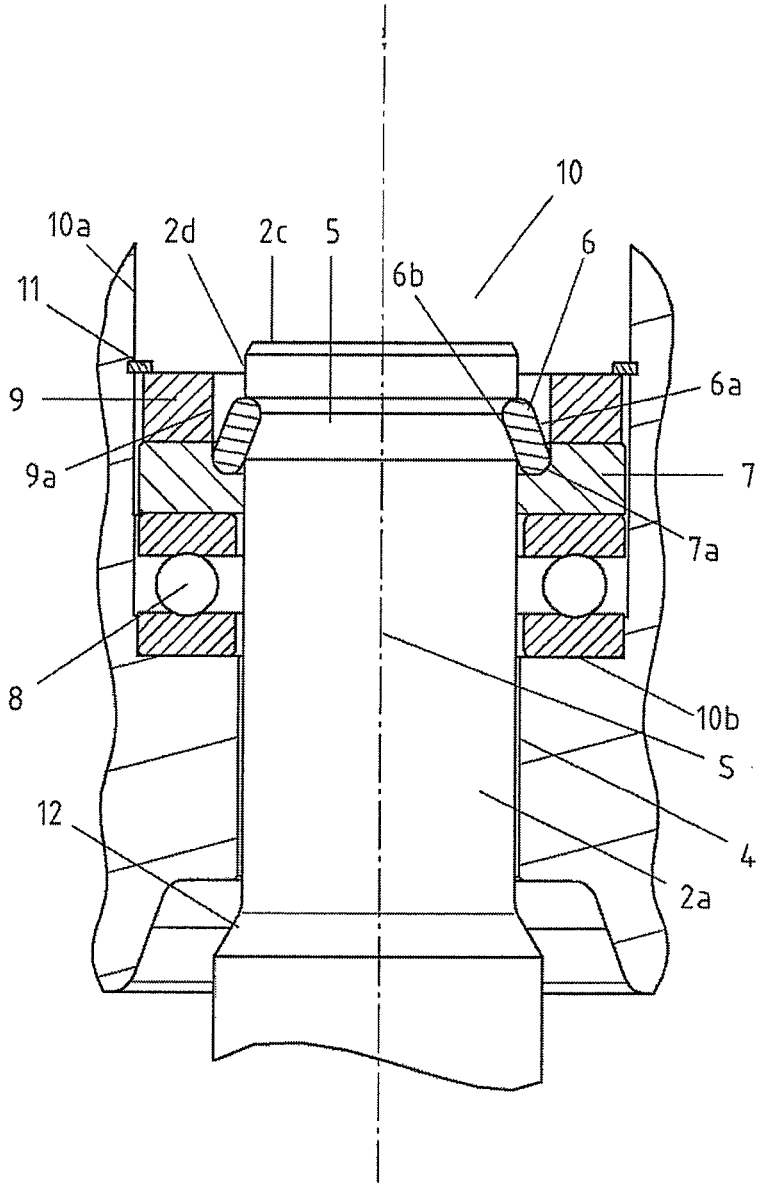
FIG. 2 is an enlarged section view taken from the region of a shaft of the hook of the load-receiving means of FIG. 1 in an operational position.

FIG. 2 shows an enlarged section from FIG. 1 from the region of the shaft 2*a* of the hook 2. In this case, the shaft 2, the retaining element 6 and the bearing ring 7 are located in their fully mounted operational position. The groove 5 in the shaft 2*a* and of the retaining element 6 is particularly clear in FIG. 2. The annular retaining element 6 is formed as a split sleeve, and this sleeve is in the form of a virtual truncated cone with a central bore widening in a conical manner, wherein the bore widens in such a way that the rest of the wall of the sleeve has a single wall thickness throughout. Compared with a retaining element 6 with a circular cross-section, the retaining element 6 in accordance with the invention is elongate in form when seen in the direction of the force flux through the retaining element 6. The force flux runs uniformly between the supporting surface 6*c* and the standing surface 6*d*, and tangentially with respect to the outer boundary surface 6*a* and the inner boundary surface 6*b*. In an advantageous manner, no shearing stresses arise in the retaining element as compared with a circular retaining element 6. In a corresponding manner and according to the conventional description of a truncated cone, the sleeve-like retaining element 6 also has an inner boundary surface 6*b* in addition to an outer boundary surface 6*a*, an upper end surface and a lower end surface. The outer boundary surface 6*a* and the inner boundary surface 6*b* are oriented in parallel with each other so that the annular retaining element 6 has a uniform thickness except for the region of its ends. In a truncated cone, the upper end surface and the lower end surface are formed as planar surfaces. In this present case, the upper end surface is in the form of a convexly curved supporting surface 6*c*. The lower end surface is in the form of a convexly curved standing surface 6*d*. The supporting surface 6*c* and the standing surface 6*d* are advantageously in the form of a circular arc. The groove 5 is formed in such a way that the retaining element 6 lies with at least partial portions of its inner boundary surface 6*b* and of its supporting surface 6*c* in the groove 5 in a surface-contacting manner. It is sufficient for the supporting surface 6*c* to lie in the groove 5 to ensure problem-free operation. The retaining element 6 widens as seen in the direction of the shaft axis S and in the direction towards the bearing surface 7*a*. Furthermore, for assembly reasons, the retaining element 6 is divided into a first half-ring-shaped segment 6*e* and a second half-ring-shaped-segment 6*f*. It is fundamentally also possible to divide the retaining element 6 into more than two segments 6*e*, 6*f*.

Furthermore, FIG. 2 shows that the retaining element 6 locks the shaft 2*a* and prevents it from moving out of the through opening 4. The groove 5 is located essentially on the upper supporting surface 6*c* of the retaining element 6 and the retaining element 6 is supported with its lower standing surface 6*d* on the bearing surface 7*a* of the bearing ring 7. The contour of the bearing surface 7*a* is formed in such a way that the retaining element 6 lies with at least a partial portion of its lower standing surface 6*d* in surface contact with the bearing surface 7*a*.

During operation of the load-receiving means 1 it may also be the case that the hook 2 is placed on an object or a load and the shaft 2*a* is moved into the through opening 4 until a conical shoulder 12, which forms the transition between the hook part 2*b* and the shaft 2*a* which has a smaller diameter than the hook part 2*b*, comes into position on the cross-piece 3 or a part of the suspension element, not shown. In this way, the retaining element 6 can also move out of the bearing ring 7, which, in the case of a retaining element 6 divided into segments 6*e*, 6*f*, could lead to the retaining element 6 exiting the groove 5 in the lateral direction. In order to prevent this, a locking ring 9 is disposed on the bearing ring 7, the inner linear peripheral surface 9*a* of which locking ring, which extends in parallel with the shaft axis S, is flush with the upper end of the bearing surface 7*a*, or the diameter of the inner linear peripheral surface 8*a* thereof corresponds to the maximum outer diameter of the retaining element 6. A small amount of clearance which facilitates assembly can be provided between the bearing ring 7 and the retaining element 6. In order for the locking ring 9 to retain contact with the bearing ring 7 in the axial direction, the bearing ring 7, the locking ring 9 and the axial bearing 8 are surrounded concentrically by the inner wall 10*a* of the receiving space 10 of the cross-piece 3. An inner groove 10*c* is disposed in the inner wall 10*a*, into which groove a commercially available securing ring 11 is inserted. In relation to a vertically oriented shaft axis S the height of the inner groove 10*c* or the spacing with respect to the bearing ring 7 is selected in such a way that the securing ring 11 prevents the locking ring 9 from being lifted off the bearing ring 7.

Figure 3:
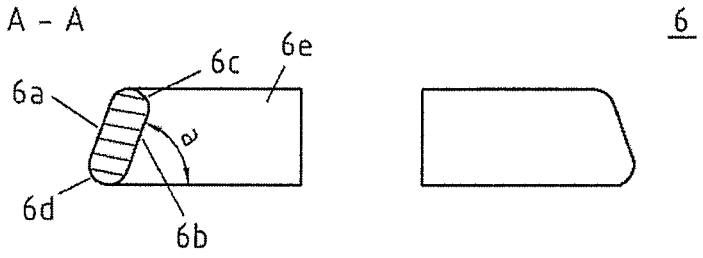
FIG. 3 is an enlarged cross-sectional view of half of a retaining element.
Figure 4:
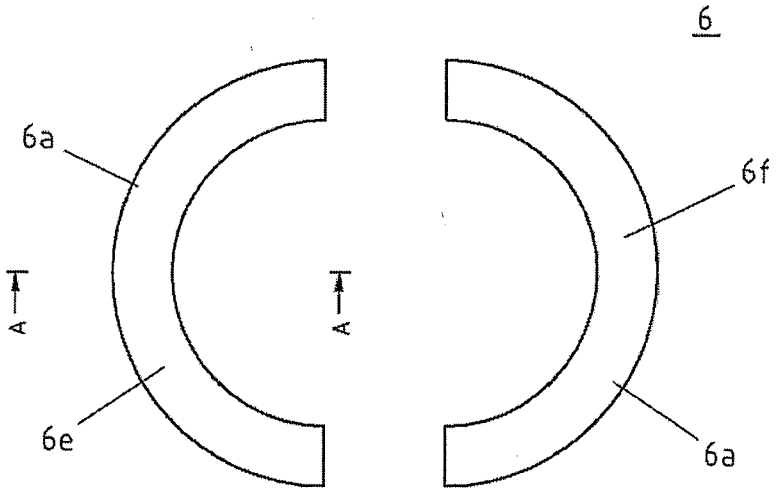
FIG. 4 is a top plan view of the retaining element of FIG. 3.

FIG. 3 shows an enlarged cross-sectional view of the first segment 6*e* of the retaining element 6 along the line of cut A-A shown in FIG. 4. Accordingly, the upper end surface includes a convexly curved supporting surface 6*c* and the lower end surface includes a convexly curved standing surface 6*d*. In an advantageous manner the convex curves are in the form of circular arcs. Therefore, the retaining element 6 as a whole has a running-track-shaped cross-section. The supporting surface 6*c* merges at one end tangentially into the outer boundary surface 6*a* and at the other end into the inner boundary surface 6*b*. The standing surface 6*d* then adjoins this. The outer boundary surface 6*a* and the inner boundary surface 6*b* are formed in parallel with each other and are inclined by an angle a of about 70° in the case of a retaining ring 6 resting on a planar surface. The angle a is enclosed between the outer boundary surface 6*a* and the inner boundary surface 6*b* and the planar surface. In an advantageous manner, the angle a is in the range of 60° to 80°.

It is fundamentally also possible to form the upper end surface from a horizontal linear upper portion and an adjoining curved supporting surface 6*c* and to form the lower end surface from a horizontal linear lower portion and an adjoining curved standing surface 6*d*. The retaining element 6 then has a parallelogram-shaped cross-section, wherein the upper inner corners are rounded off by the supporting surface 6*c* and the lower outer corners are rounded off by the standing surface 6*d*.

FIG. 4 illustrates a top plan view of the retaining element 6 which is divided into the first half-ring-shaped segment 6*e* and the second half-ring-shaped segment 6*f*. It is fundamentally also possible to divide the retaining element 6 into more than two segments 6*e*, 6*f*.

Figure 5:
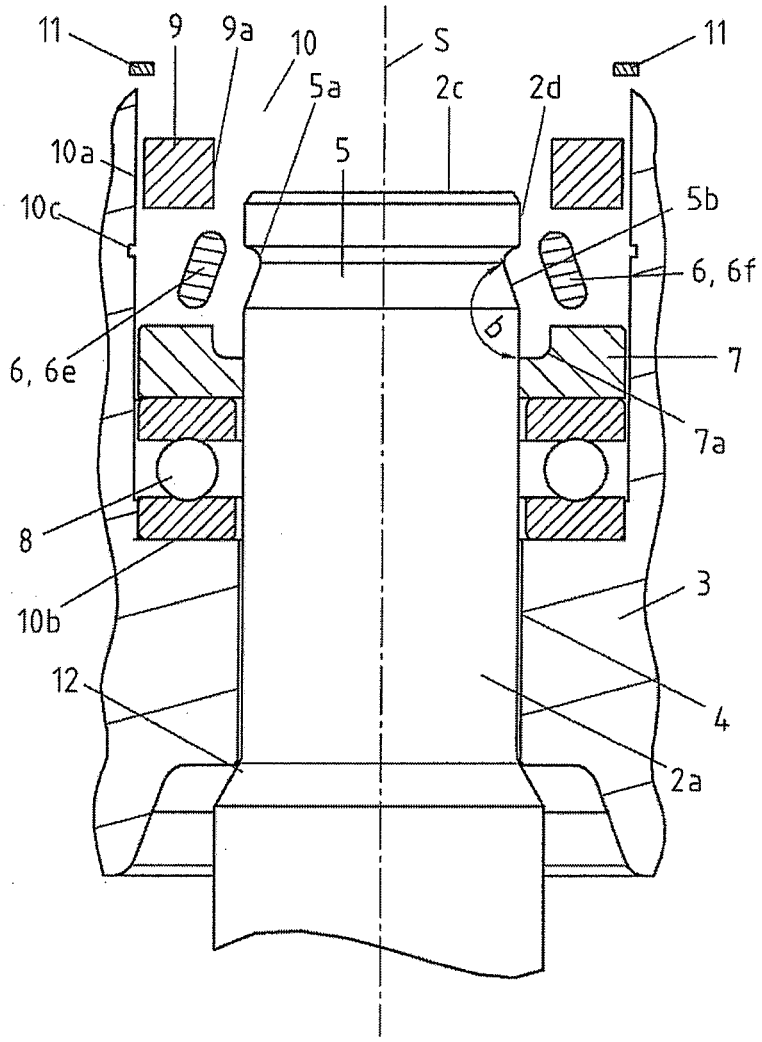
FIG. 5 is a partially exploded enlarged section view similar to FIG. 2, shown with the retaining element in a mounted position.

FIG. 5 shows a partially exploded view similar to that of FIG. 2, wherein the shaft 2*a* is located in a mounted position. In order to connect the hook 2 to the cross-piece 3, the shaft 2*a* of the hook 2 is guided in a first step through the through opening 4 of the cross-piece 3. Prior or subsequent to this the axial bearing 8 and the bearing ring 7 are placed onto the receiving surface 10*b* of the cross-piece 3 concentric to the through opening 4. As shown in FIG. 5, the shaft 2*a* of the hook 2 has been pushed through the through opening 4 so far that, as seen in the direction of a vertically oriented shaft axis S, the groove 5 is located completely above the bearing ring 7 and is thus freely accessible from the side. The shoulder 12 then contacts the cross-piece 3 from below. Then, in a next step, the segments 6*e*, 6*f* of the retaining element 6 are inserted laterally into the groove 5 so that the segments 6*e*, 6*f* complement each other to form a complete annular retaining element 6. In this position the segments 6*e*, 6*f* are held and the shaft 2*a* is moved downwards through the through opening 4 until the standing surfaces 6*d* of the segments 6*e*, 6*f* of the retaining element 6 come into position on the bearing surface 7*a*. Then the locking ring 9 is inserted and locked via the securing ring 11 (see FIG. 2) which is clamped for this purpose into an inner groove 10*c* of the inner wall 10*a* of the receiving space 10.

Furthermore, FIG. 5 clearly shows the contour of the groove 5 and of the bearing surface 7*a* since the retaining element 6 has not yet been inserted. The groove 5 begins at the upper end starting from the cylindrical peripheral surface 2*d* of the shaft 2*a* with a curved surface 5*a* which is curved in a concave and circular manner. The length of the circular arc of the curved surface 5*a* can be defined by the so-called angle at centre in the range of 110° to 130°, such as about 120°. The angle at centre is measured between the starting radius and end radius of a portion of a circle. The circular are of the curved surface 5*a* begins at the outer peripheral surface of the shaft 2*a* and a tangent at the start of the curved surface 5*a* extends at a right angle to the outer peripheral surface of the shaft 2*a*. A smaller angle than the right angle can also be chosen in order to produce an undercut so as thereby to create additional positional securing for the retaining element 6. The curved surface 5*a* merges at its end tangentially into a linear contact surface 5*b*. The contact surface 5*b* and the adjoining peripheral surface 2*d* of the shaft 2*a* enclose an angle b in the range of 140° to 160°, such as about 150°. The contour of the curved surface 5*a* and of the contact surface 5*b* is formed in such a way that the retaining element 6 comes into position, with its supporting surface 6*c* and the adjoining predominant part of the inner boundary surface 6*b* being in surface contact. In order for the retaining element 6 to function, it is not necessary for the retaining element 6 to come into the contact position with the contact surface 5*b* with its predominant part of the inner boundary surface 6*b*. The contact with the supporting surface 6*c* is sufficient. As seen in the direction of the end 2*c* of the shaft 2*a*, the depth of the groove 5 thus increases. The bearing surface 7*a* is curved in a concave and circular manner and the circular arc thereof is of a length of about 90° in relation to the angle at centre. The contour of the bearing surface 7*a* is formed in such a way that the retaining element 6 comes into position, with the predominant part of its standing surface 6*d* being in surface contact. Furthermore, the bearing surface 7*a* is disposed inside and on top of the bearing ring 7.

The invention claimed is:

1. A load-receiving apparatus in the form of a hook block of a lifting gear, said load-receiving apparatus comprising:

a suspension element having a bearing surface;

a hook having a shaft with a peripheral groove, a portion of the shaft being received in the suspension element; and an annular retaining element engaging the peripheral groove of the shaft, the annular retaining element being supported on the bearing surface of the suspension element, the annular retaining element comprising a conical sleeve in the manner of a truncated hollow cone that widens starting from the shaft to the bearing surface, the annular retaining element including an outer boundary surface, an inner boundary surface, an upper annular end surface, and a lower annular base surface;

wherein the annular retaining element has an upper supporting surface that faces and contacts the shaft and a lower standing surface that faces and contacts the bearing surface of the suspension element, and wherein the inner boundary surface and the outer boundary surface of the annular retaining element extend in parallel with each other.

2. The load-receiving apparatus as claimed in claim 1, wherein the upper supporting surface and the lower standing surface are each curved convexly in the form of arc sections of respective circles.

3. The load-receiving apparatus as claimed in claim 2, wherein the upper annular end surface of the retaining element is formed in the shape of the upper supporting surface and the lower annular end surface of the retaining element is formed in the shape of the lower standing surface.

4. The load-receiving apparatus as claimed in claim 2, wherein the peripheral groove has a curved surface that contacts the upper supporting surface of the annular retaining element.

5. The load-receiving apparatus as claimed in claim 4, wherein the upper supporting surface and the curved surface of the peripheral groove have respective contours that correspond to each other when in a contact position.

6. The load-receiving apparatus as claimed in claim 5, further comprising a linear contact surface that adjoins the curved surface of the peripheral groove, the linear contact surface widening in the direction of the bearing surface of the suspension element, and the annular retaining element arranged with its inner boundary surface on the contact surface of the peripheral groove.

7. The load-receiving apparatus as claimed in claim 6, wherein the bearing surface of the suspension element and the standing surface of the annular retaining element have respective contours correspond to each other when in a contact position.

8. The load-receiving apparatus as claimed in claim 7, further comprising a bearing ring supported via an axial ball bearing on the suspension element, wherein the bearing surface of the suspension element is disposed inside and on top of the bearing ring.

9. The load-receiving apparatus as claimed in claim 8, wherein the annular retaining element is divided into at least two segments.

10. The load-receiving apparatus as claimed in claim 1, wherein the upper annular end surface of the retaining element is formed in the shape of the upper supporting surface and the lower annular end surface of the retaining element is formed in the shape of the lower standing surface.

11. The load-receiving apparatus as claimed in claim 10, further comprising a linear contact surface that adjoins the curved surface of the peripheral groove, the linear contact surface widening in the direction of the bearing surface of the suspension element, and the annular retaining element arranged with its inner boundary surface on the contact surface of the peripheral groove.

12. The load-receiving apparatus as claimed in claim 1, wherein the peripheral groove has a curved surface that contacts the upper supporting surface of the annular retaining element.

13. The load-receiving apparatus as claimed in claim 12, wherein the upper supporting surface and the curved surface of the peripheral groove have respective contours that correspond to each other when in a contact position.

14. The load-receiving apparatus as claimed in claim 13, further comprising a linear contact surface that adjoins the curved surface of the peripheral groove, the linear contact surface widening in the direction of the bearing surface of the suspension element, and the annular retaining element arranged with its inner boundary surface on the contact surface of the peripheral groove.

15. The load-receiving apparatus as claimed in claim 1, wherein the bearing surface of the suspension element and the standing surface of the annular retaining element have respective contours that correspond to each other when in a contact position.

16. The load-receiving apparatus as claimed in claim 1, further comprising a bearing ring supported via an axial ball bearing on the suspension element, wherein the bearing surface of the suspension element is disposed inside and on top of the bearing ring.

17. The load-receiving apparatus as claimed in claim 1, wherein the annular retaining element is divided into at least two segments.

18. The load-receiving apparatus as claimed in claim 1, further comprising a bearing ring supported via an axial ball bearing on the suspension element, wherein the bearing surface of the suspension element is disposed inside and on top of the bearing ring.

* * * * *

UNITED STATES PATENT AND TRADEMARK OFFICE

CERTIFICATE OF CORRECTION

PATENT NO. : 8,608,215 B2
APPLICATION NO. : 13/262769
DATED : December 17, 2013
INVENTOR(S) : Christoph Passmann et al.

It is certified that error appears in the above-identified patent and that said Letters Patent is hereby corrected as shown below:

In the Specification,

Column 3
Line 13, “that” should be --that,--

Column 7
Line 22, “are” should be --arc--

Signed and Sealed this
Tenth Day of March, 2015

Michelle K. Lee

Michelle K. Lee
*Deputy Director of the United States Patent and Trademark Office*